US006237878B1

(12) United States Patent
Nelson

(10) Patent No.: US 6,237,878 B1
(45) Date of Patent: May 29, 2001

(54) APPARATUS FOR HOLDING A PLASTIC BAG

(76) Inventor: Mike Nelson, 505 S. Arlington, Ste. 102, Reno, NV (US) 89509

( * ) Notice: Subject to any disclaimer, the term of this patent is extended or adjusted under 35 U.S.C. 154(b) by 0 days.

(21) Appl. No.: 08/998,587

(22) Filed: Dec. 29, 1997

(51) Int. Cl.[7] ..... A63B 55/04; B65B 67/04
(52) U.S. Cl. ..... 248/99; 248/97
(58) Field of Search ..... 248/99, 95, 97, 248/100, 101, 151, 146

(56) References Cited

U.S. PATENT DOCUMENTS

| | | | | |
|---|---|---|---|---|
| 746,988 | * | 12/1903 | Olin | 248/97 |
| 750,174 | * | 1/1904 | Denise et al. | 248/97 |
| 4,317,550 | * | 3/1982 | Hannah | 248/95 |
| 4,437,634 | | 3/1984 | Hambleton | 248/97 |
| 4,467,989 | * | 8/1984 | Stroh | 248/97 |
| 4,763,808 | | 8/1988 | Guhl et al. | 220/404 |
| 4,802,647 | | 2/1989 | Celmayster et al. | 248/544 |
| 4,805,857 | * | 2/1989 | Travis | 248/97 |
| 4,810,031 | | 3/1989 | Patterson | 297/192 |
| 4,921,193 | | 5/1990 | Benesch | 248/97 |
| 4,934,636 | * | 6/1990 | Orlosky et al. | 248/95 |
| 4,957,252 | | 9/1990 | Watkins | 248/97 |
| 5,100,087 | | 3/1992 | Ashby | 248/97 |
| 5,169,101 | | 12/1992 | Wenzel et al. | 248/97 |
| 5,263,672 | * | 11/1993 | He | 248/97 |
| 5,427,340 | * | 6/1995 | Stromsmoe et al. | 248/97 |

* cited by examiner

*Primary Examiner*—Anita M. King
*Assistant Examiner*—C Williams
(74) *Attorney, Agent, or Firm*—Limbach & Limbach L.L.P.

(57) ABSTRACT

An apparatus to hold open for loading a limp plastic bag, such as a grocery bag used as a trash receptacle, includes a generally rectangular and horizontal base, four upstanding legs each attached to a corner of the base, and two generally horizontal handle engaging members each spanning between the top ends of two adjacent legs. The handle engaging members protrude through the bag handles to support the bag in an open manner over the base. The handle engaging members have angled surfaces to fully extend the opening on a variety of different sized bags. The base has a recessed central portion for containing any liquids spilled from the bag.

6 Claims, 2 Drawing Sheets

APPARATUS FOR HOLDING A PLASTIC BAG

BACKGROUND OF THE INVENTION

1. Field of the Invention

The present invention relates generally to an apparatus for holding a plastic bag, and more particularly to an improved stand for holding a plastic bag open for use, such as for loading trash or recycled materials therein.

2. Discussion of the Prior Art

"Paper or plastic?" Customers are typically asked which type of bag they would like their purchased items put in at the grocery store checkout stand. Today, more and more customers are taking their items home in expendable/recyclable thermoplastic bags. The advantages of plastic bags are numerous. Handles on plastic bags, usually a pair of holes cut out on opposite sides of the mouth of the bag, make it easier to pick up and carry the bags, and to hold more bags at one time. Plastic bags take up far less room than paper bags in storage, during shipping, in the store, at home, and in landfills. Plastic bags cost about one sixth as much to produce as their paper counterparts. Plastic bags are also easily recyclable. Plastic bags offer better tear strength and moisture resistance. Because of the many advantages of plastic bags, the general trend of grocery and other retail stores is away from paper and toward the exclusive use of plastic.

One reason many customers still prefer the use of paper bags is that they are able to use them to line trash receptacles. A typical kitchen waste receptacle is designed to removably receive a paper grocery sac to line its interior. Plastic bags generally are not an acceptable substitute for this purpose because of their smaller depth, tapered sides, and lack of rigidity. If one does not use paper bags to line the typical receptacle, plastic trash bags of a size designed specifically for this use must be purchased. In other words, the customer is unable to reuse his or her grocery bags, and must pay for trash receptacle liners instead.

Special stands or supports have previously been designed for holding plastic grocery bags open for use as a trash or recycle containers. Examples are described in U.S. Pat. Nos. 4,437,634, 4,802,647, 4,810,031, 4,921,193, 4,957,252, and 5,169,101. However, these devices have their drawbacks. Because of their lightweight wire-frame designs, many of these devices are not particularly stable, especially when carrying an empty plastic bag. Since plastic bags with handles are manufactured in a variety of sizes and styles, these prior art stands cannot work as well with some types of bags as with others. If a plastic bag develops a hole and leaks liquid from its contents, prior art stands do nothing to contain the spill. Plastic bags can also be difficult to remove from the prior art stands once the bags have been filled.

In order to allow retailers and consumers to fully exploit the many advantages of plastic bags, what is needed is a plastic bag holder that is lightweight but stable, low cost, easy to load and unload, accommodates various sizes of bags, and contains spills.

SUMMARY OF THE INVENTION

The present invention is an apparatus for holding a plastic grocery bag open for loading, such as for containing trash or items to be recycled.

A bag holding stand constructed according to the preferred embodiment of the present invention includes: a generally rectangular and horizontal base having four corner portions and a recessed central portion; four generally vertical elongated legs, each leg having an upper and a lower end, each leg being attached at its lower end to one of the corner portions of the base member; and two generally horizontal elongated handle engaging members each spanning between the upper ends of two adjacent legs, each handle engaging member having two end portions, a middle offset portion, and two angled portions each connecting the middle offset portion to one of the end portions, the two angled portions forming a pair of outwardly facing opposing angled surfaces for engaging opposite ends of one of the bag handles and extending the handle open laterally with respect to the base member, the four angled surfaces cooperating to create a rectangular opening at the mouth of the bag over the base member by extending the opening of the bag substantially taut both laterally and longitudinally.

In accordance with one aspect of the present invention, the base of the bag stand is provided with a central portion recessed from the base periphery for catching and retaining any liquids spilled from the plastic bag.

In accordance with another aspect of the invention, four angled surfaces are provided to receive the handles of the plastic bag and spread each handle and the mouth of the bag open laterally, as well as spreading the two handles apart from each other to open the bag longitudinally. Because the surfaces that contact the bag handles are angled, a wide range of different bags having various sizes of handles can be accommodated. Bags having small handles contact the angled surfaces further out. Bags having larger handles contact the angled surfaces further in, but are still spread outward as far as possible by the angled surfaces rather than drooping inward and causing the opening of the bag to collapse.

In accordance with still another aspect of the invention, the base of the bag stand is large enough and the legs are stiff enough to allow the apparatus to be free standing in a stable fashion, even when holding an empty plastic bag.

In accordance with yet another aspect of the invention, mounting means are provided to allow the apparatus to be mounted on a wall, inside a cabinet door, or the like.

In accordance with yet another aspect of the invention, the apparatus is designed to allow the legs to flex together a predetermined amount to facilitate the removal of a loaded plastic bag from the handle engaging members. Horizontal slots are also provided in the mounting means to allow the legs to flex even when the apparatus is mounted rather than freestanding.

In accordance with yet another aspect of the invention, the handle engaging members are located a predetermined height above the base to allow the bottom of most plastic bags to rest on the base rather than being fully suspended. This arrangement keeps the mouth of the bag wide open rather than having the weight of the bag contents tending to draw the mouth closed.

In accordance with yet another aspect of the invention, the entire apparatus is formed from injection molded plastic and each of the four legs and two handle engaging members is a beam having a generally rectangular cross-section. This arrangement allows the apparatus to be low cost, yet sturdy.

In accordance with yet another aspect of the invention, the base, legs, and handle engaging members are separate pieces which are removably attached together. Preferably, each connection consists of a pair of resilient barbed fingers formed on one member, and a socket formed on an adjoining member for releasably receiving the fingers. This arrangement allows the product to be compact for packaging and shipping, allows for simple snap-together construction to save assembly costs and/or time, and allows the unit to be broken down for compact storage when not in use.

DETAILED DESCRIPTION OF THE PREFERRED EMBODIMENT

Figure 1:
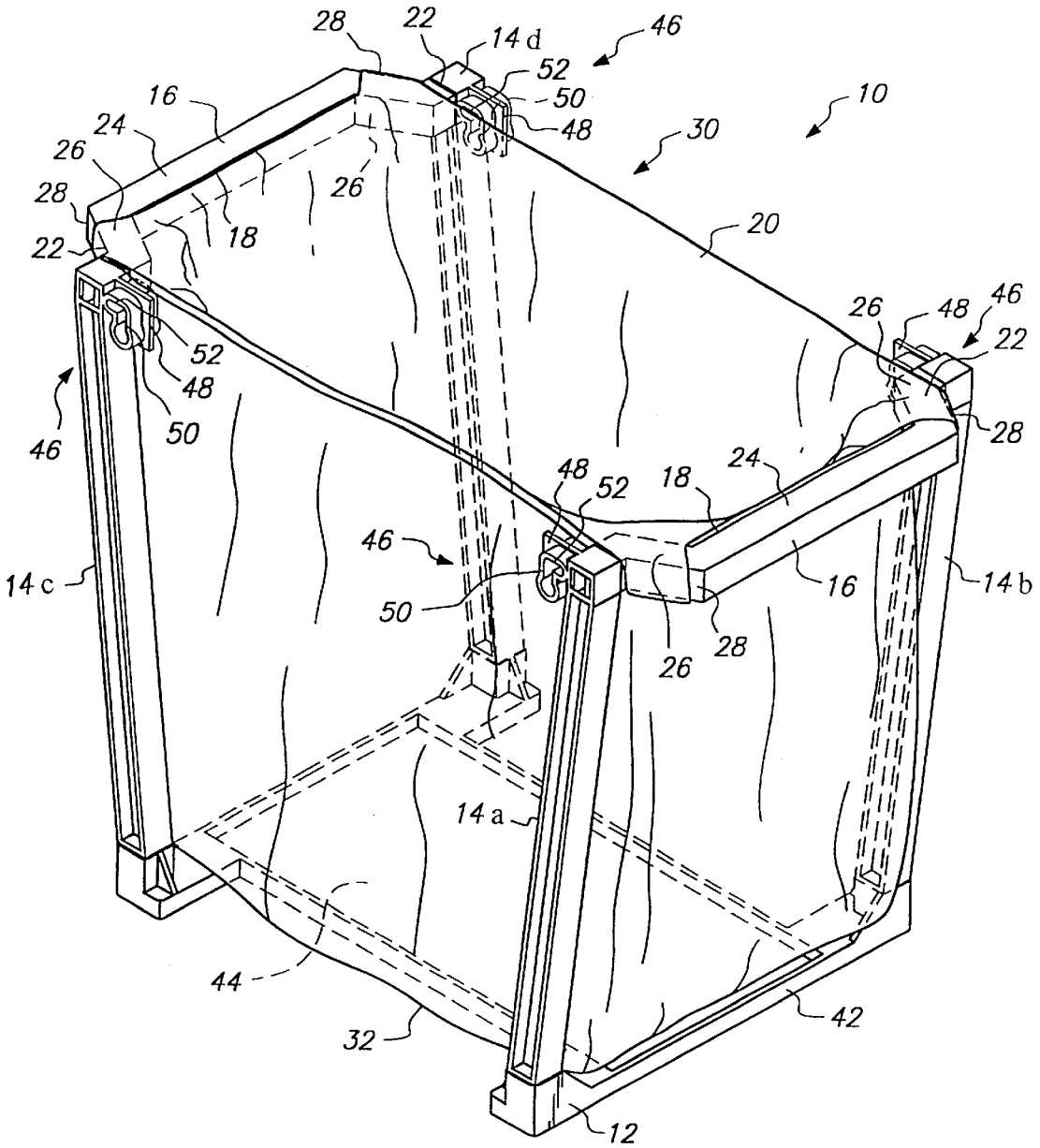
FIG. 1 is a perspective view showing an apparatus constructed according to the present invention holding a bag open for loading.

Referring to FIG. 1, a plastic bag stand 10 constructed according to the preferred embodiment of the present invention is shown. Bag stand 10 includes a generally rectangular and horizontal base 12, four upstanding legs 14 each attached to a corner of the base, and two generally horizontal handle engaging members 16 each spanning between the top ends of two adjacent legs 14. Handle engaging members 16 protrude through bag handles 18 to support bag 20 in an open manner over base 12.

Each of the two handle engaging members 16 has two end portions 22, a middle offset portion 24, and two angled portions 26. Each angled portion 26 connects the middle offset portion 24 to one of the end portions 22, which in turn is attached to the top of one of the legs 14. The two angled portions 26 form a pair of outwardly facing, opposing angled surfaces 28 for engaging opposite ends of bag handle 18. Each pair of angled surfaces 28 acts to extend one handle 18 open laterally, thereby opening the mouth 30 of bag 20 laterally (with respect to base 12.) The two pairs of angled surfaces 28 cooperate to extend the two bag handles 18 apart longitudinally, thereby opening the mouth 30 of bag 20 longitudinally. In this manner, mouth 30 is opened in a generally rectangular fashion.

Surfaces 28 are angled so that stand 10 can support a wide range of bags having handles of various sizes. Bags having smaller handles contact angled surfaces 28 closer to middle offset portions 24 of handle engaging members 16. Bags having larger handles contact angled surfaces 28 closer to end portions 22. Unlike prior art bag stands that have handle engaging members with fixed spacings, the present invention uses angled surfaces 28 to expand virtually any size bag handle 18 outward as far as possible to prevent bag 20 from drooping inward and causing the opening of the bag to collapse.

Preferably, legs 14 have a predetermined height that allows the bottom 32 of bag 20 to rest on base 12, rather than be fully suspended between the two handle engaging members 16. This prevents mouth 30 from tending to draw closed from the weight of the contents loaded into bag 20.

Figure 2:
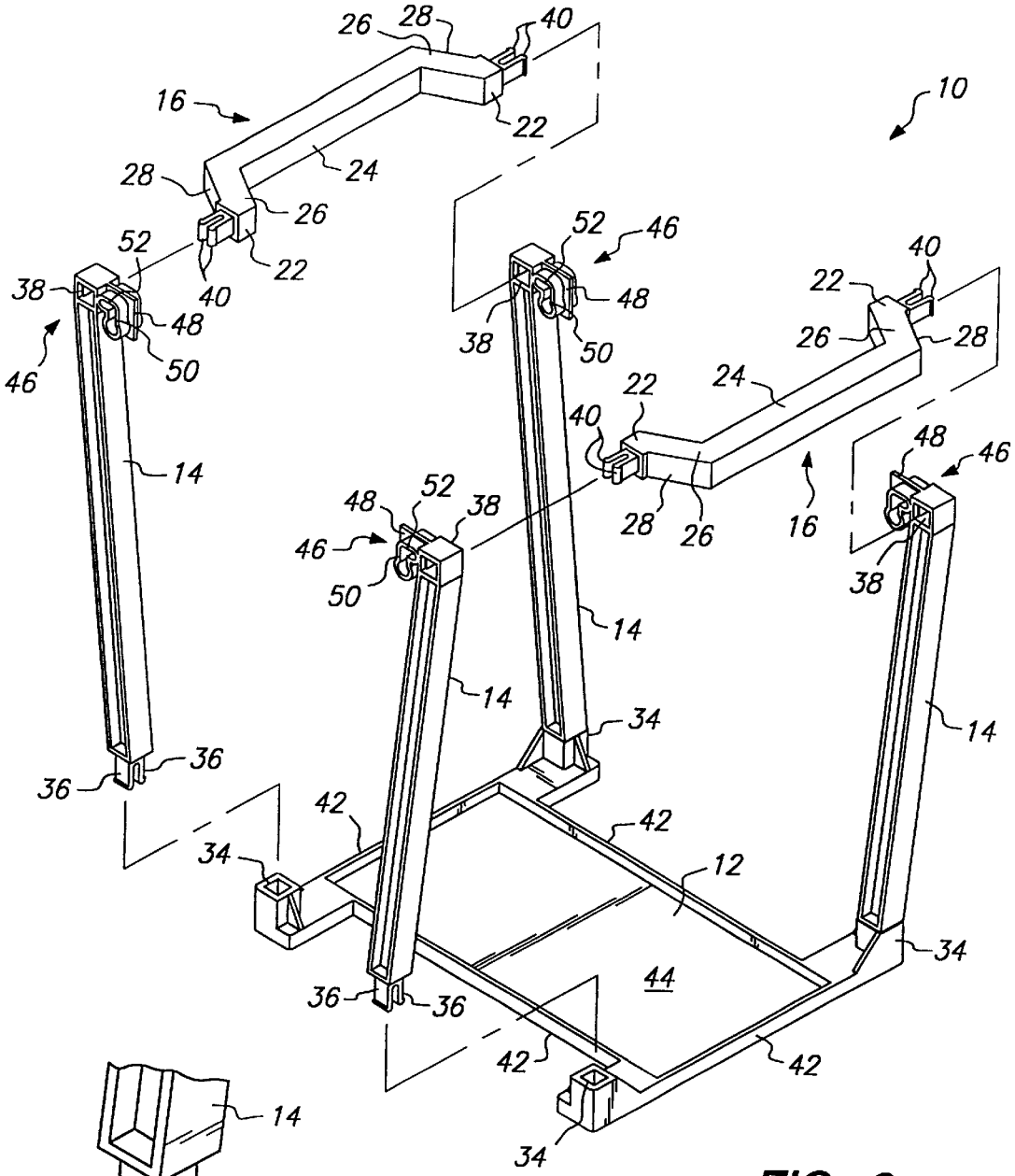
FIG. 2 is an exploded perspective view similar to FIG. 1.

Referring to FIG. 2, an exploded view of the individual members of bag stand 10 is shown. Base 12, legs 14 and handle engaging members 16 are preferably separate, injection molded plastic members that are releasably interconnected. Preferably, all four legs 14 are identical, and both handle engaging members 16 are identical, to reduce the number of different parts required to three.

Figure 3:
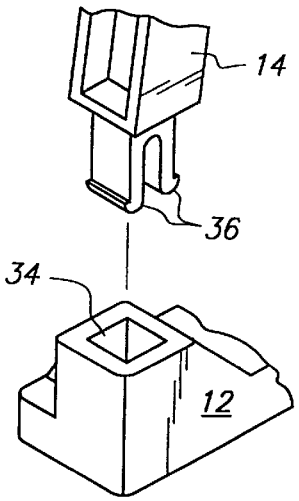
FIG. 3 is an enlarged fragmentary view showing a corner of the inventive apparatus.

Referring to FIGS. 2 and 3, sockets 34 are formed at the corners of base 12 for releasably receiving barbed fingers 36 formed on the lower ends of legs 14. Similarly, sockets 38 are formed in the top of legs 14 for releasably receiving barbed fingers 40 formed in end portions 22 of handle engaging members 16. With this arrangement, the individual members can be economically produced and shipped in a compact manner, and the user can quickly and easily assemble bag stand 10 without tools or fasteners. The unit can be disassembled for compact moving or storage when not in use by either pulling apart the members directly, or by using a tool with a V-shaped tip (not shown) or one's fingers to compress barbed fingers 36 and 40 for release. Other types of disengageable connection features well know in the art can be used in place of the sockets 34, 38 and barbed fingers 36, 40 shown. Alternatively, the inventive bag stand can be formed in a single unitary piece, or have snap-together connections that are not releasable once assembled.

Base 12 has a raised peripheral portion 42 relative to the recessed central portion 44. This arrangement acts to contain any liquids on base 12 that may be spilled from bag 20.

An inverted L-shaped mounting slot 46 is provided on an appendage 48 on each leg 14 to allow bag stand 10 to be mounted on a wall, cabinet, or door, etc. The lower leg 50 of slot 46 is keyhole-shaped for receiving the protruding head of a screw. The upper leg 52 of slot 46 receives the shank of the screw and extends horizontally to allow legs 14 to be flexed towards one another. This can facilitate the removal of bag handles 18 from handle engaging members 16 when bag 20 is fully loaded. Alternatively, separate mounting brackets (not shown) can be provided for attaching to a wall and for snapping into legs 14 or handle engaging members 16.

Figure 4:
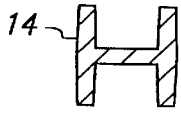
FIG. 4 is a cross-sectional view showing the I-beam shape of a leg.
Figure 5:
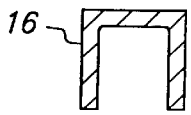
FIG. 5 is a cross-sectional view showing the C-shaped cross-section of a handle engaging member.

Referring to FIGS. 4 and 5, legs 14 and handle engaging members 16 preferably each have a generally constant cross-section that has a square outline. The I-beam shaped cross-section of leg 14 and the C-shaped cross-section of member 16 allows members 14 and 16 to be lightweight yet stiff. Handle engaging members 16 preferably have several stiffening ribs (not shown) spanning between opposing sides of the cross-section and laterally spaced along the length of member 16. Legs 14 preferably angle outwardly away from each other in the longitudinal direction of base 12, as shown in FIG. 1. In alternative embodiments (not shown), it is envisioned that features of bag stand 10, including cross-sections and angled surfaces 28, may be rounded to provide a more aesthetically pleasing appearance.

The above descriptions and drawings are for illustrative purposes only. It is to be understood that the present invention is not limited to the sole embodiments described above and illustrated herein, but encompasses any and all variations falling within the scope of the appended claims.

What is claimed as the invention is:

1. An apparatus to hold open for loading a limp plastic bag having a pair of integral handles, the apparatus comprising:

a horizontal base member;

at least two generally vertical elongated members attached at their lower ends to opposite sides of the base member;

two generally horizontal handle engaging members each mounted atop one of the vertical members for engaging one of the handles of the bag and suspending the bag over the base member between the handle engaging members, the engaging members serving to create a generally rectangular opening at the mouth of the bag; and mounting means located on upper portions of the vertical members for attaching the apparatus to a vertical surface, the mounting means including a horizontally extending slot for allowing the handle engaging members to move towards each other to facilitate removing the bag handles therefrom.

2. An apparatus to hold open for loading a limp plastic bag having a pair of integral handles,the apparatus comprising:

a generally rectangular and horizontal base having four corner portions;

four generally vertical elongated legs, each leg having an upper and a lower end, each leg being attached at its lower end to one of the corner portions of the base member; and two generally horizontal elongated handle engaging members each spanning between the upper ends of two adjacent legs, each handle engaging member having two end portions, a middle offset portion, and two angled portions each connecting the middle offset portion to one of the end portions, the two angled portions forming a pair of outwardly facing opposing angled surfaces for engaging opposite ends of one of the bag handles and extending the opposite ends of the one bag handle apart laterally with respect to the base member, each angled surface extending away from the opposing angled surface and generally toward the other pair of angled surfaces so that as the two bag handles are drawn inward and downward toward each other the opposite ends of each of the bag handles are moved laterally apart to extend the bag opening laterally outward, the four angled surfaces cooperating to create a rectangular opening at the mouth of the bag over the base member by extending the opening of the bag substantially taut both laterally and longitudinally, wherein the base member has a central portion for catching any liquid released from the bag and a raised peripheral portion for retaining the liquid in the central portion.

3. An apparatus according to claim 2 wherein [the] each of the four legs includes a lower portion which is vertical, and an upper portion which is outwardly inclined.

4. An apparatus according to claim 2 wherein the entire apparatus is formed from injection molded plastic and each of the four legs and two handle engaging members is a beam having a generally rectangular cross-section.

5. An apparatus according to claim 4 wherein a disengagable connection feature is formed on each of the corner portions of the base and on each of the ends of the legs and handle engaging members to allow the base, legs, and handle engaging members of the apparatus to be snapped together and completely separated from each other without separate fasteners or tools.

6. An apparatus according to claim 5 wherein each disengagable connection includes a pair of resilient barbed fingers formed on one member and a socket formed on the adjoining member for releasably receiving the fingers.

* * * * *